United States Patent [19]

Sédillot et al.

[11] 4,453,859

[45] Jun. 12, 1984

[54] DEVICE FOR CONNECTING AND DISCONNECTING THE SWIVEL OF AN OSCILLATING MARINE PLATFORM AND A METHOD FOR PUTTING THE SAID DEVICE INTO USE

[75] Inventors: Francois G. Sédillot, Velizy; William L. Hudson; Bernard Castellan, both of Paris, all of France

[73] Assignee: Compagnie Generale pour les Developpements Operationnels des Richesses sous-Marines"C. G. Doris", Paris, France

[21] Appl. No.: 390,911

[22] Filed: Jun. 22, 1982

[30] Foreign Application Priority Data

Jun. 23, 1981 [FR] France ..... 81 12282

[51] Int. Cl.[3] ..... E02B 17/00

[52] U.S. Cl. ..... 405/202; 52/40; 405/195

[58] Field of Search ..... 405/202, 195, 224, 203; 405/204; 166/338; 52/40; 114/264, 265

[56] References Cited

U.S. PATENT DOCUMENTS

| | | | |
|---|---|---|---|
| 3,332,484 | 7/1967 | Watkins | 166/338 |
| 3,522,709 | 8/1970 | Vilain | 405/202 |
| 3,766,582 | 10/1973 | Lloyd et al. | 405/202 |
| 4,137,722 | 2/1979 | Mossiossian et al. | 405/202 |

*Primary Examiner*—Dennis L. Taylor

*Attorney, Agent, or Firm*—Wigman & Cohen

[57] ABSTRACT

The device comprises two concentric swivels, a first or mooring swivel being arranged on the outside of the second or bearing swivel, the second swivel being fixed to the end of a cartridge held in a movable manner in a tube forming a projection at the lower end of the shaft and an extension of an axial passage in the shaft. The cartridge is formed by a cage fitted with openings in which keys are housed. A ring is lowered between the keys and immobilizes them against the wall of the tube which forms an extension of the axial passage in the shaft. The method consists of lowering or raising the cartridge carrying the bearing swivel by means of a set of rods.

14 Claims, 12 Drawing Figures

FIG.: 1
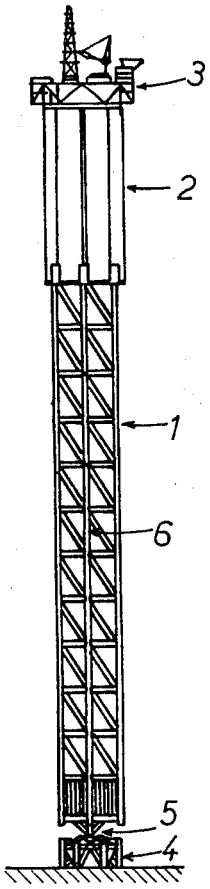
FIG.: 5
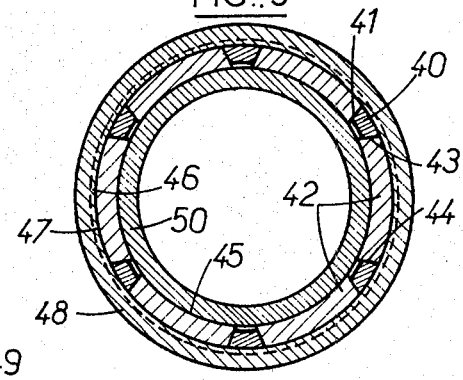
FIG.: 6
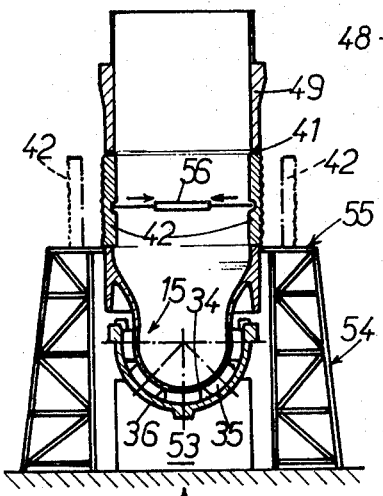
FIG.: 7
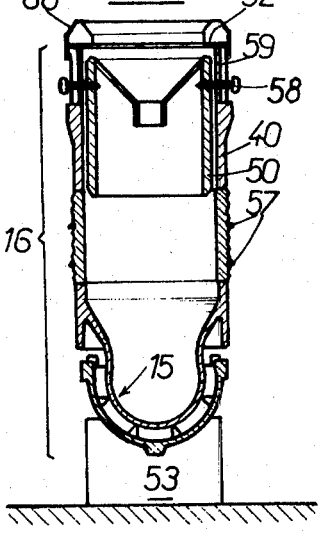
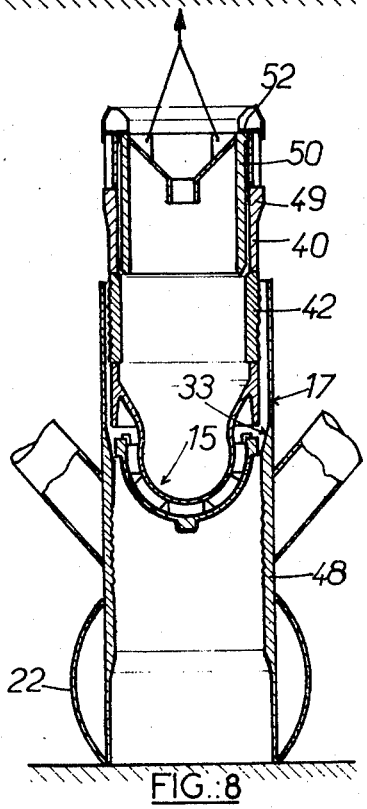
FIG.: 8
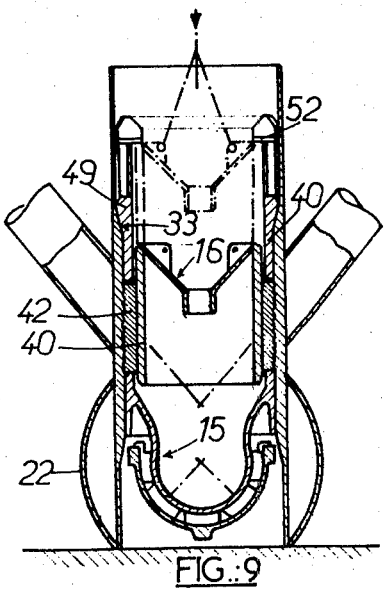
FIG.: 9

DEVICE FOR CONNECTING AND DISCONNECTING THE SWIVEL OF AN OSCILLATING MARINE PLATFORM AND A METHOD FOR PUTTING THE SAID DEVICE INTO USE

BACKGROUND OF THE INVENTION

This invention relates to a device for connecting and disconnecting the swivel of an oscillating marine platform, the said swivel being arranged between the lower end of the shaft supporting the bridge and the base fixed on to the sea bed.

French Patent Application No. 79 31842 filed in the name of the assignees describes a device permitting the assembly and dismantling of a swivel. The spherical convex surface is attached to the end of a conical pivot member which is located in a sealed casing in the end of the shaft. Flanges provided on the periphery of the casing and on the pivot member enable the pivot to be an integral part with the shaft. Deformable fittings are fixed by means of supports, on the one hand, on the convex surface and, on the other hand, on a bush which can cooperate with a concave spherical cap fixed in the base. Flanges fixed respectively on the cap and on the bush enable them to be integrated.

The weight of the unit comprising the shaft, bridge and ballast is made so as to be greater than Archimedes pressure and the upthrust due to the action of the elements. The swivel is therefore always under compression and the deformable fittings are not submitted to any tension which could cause them damage.

If it is desired to change the swivel, then the connections between the pivot member and the casing fixed in the shaft are removed, and the shaft is made lighter by emptying the floats which it carries, so as to free the pivot member. The shaft is then laterally displaced. Lifting means are attached to the pivot member and the connections between the bush and the cap fixed to the base are removed. The unit comprising the pivot member, deformable fitting and bush is reassembled for possible changing of the fittings.

This device with a pivot member and cap enables the swivel to be changed without having to dismantle the bridge installations before positioning the unit of the shaft and base.

Nevertheless, changing the swivel always takes a certain amount of time, during which the shaft and the bridge rising above it, disconnected from the base, are held solely by anchors on the sea bed. This phase becomes particularly delicate if there is a change in the condition of the sea due to bad weather, and this invention aims to eliminate this phase and to be at least partly independent of meteorological conditions. To achieve this, a double concentric swivel is provided, one of the swivels being used solely to make fast the shaft while the bearing swivel is being changed. This change is carried out by raising the bearing swivel along the axis of the shaft and through one part of the mooring swivel which is in the form of two hemispherical coaxial bushes of a type similar to that shown in U.S. Pat. No. 3,522,709.

SUMMARY OF THE INVENTION

According to the invention there is provided a device for connecting and disconnecting the swivel of an oscillating marine platform, the said swivel being arranged between the lower end of a shaft supporting a bridge and a base fixed on the sea bed, the device comprising two concentric swivels, a first mooring swivel being arranged on the outside of a second, bearing swivel, the second swivel being fixed to the end of a cartridge held in a movable manner in a tube which projects at the lower end of the shaft and forms an extension of an axial passage in the shaft.

BRIEF DESCRIPTION OF THE DRAWINGS

FIG. 1 shows an example of an oscillating platform fitted with the device according to the invention, FIG. 5 is a section along the line V—V in FIG. 4, FIGS. 6 to 9 show the formation of the cartridge bearing the swivel and its first positioning on site.

DETAILED DESCRIPTION OF THE PREFERRED EMBODIMENT

Figure 2:
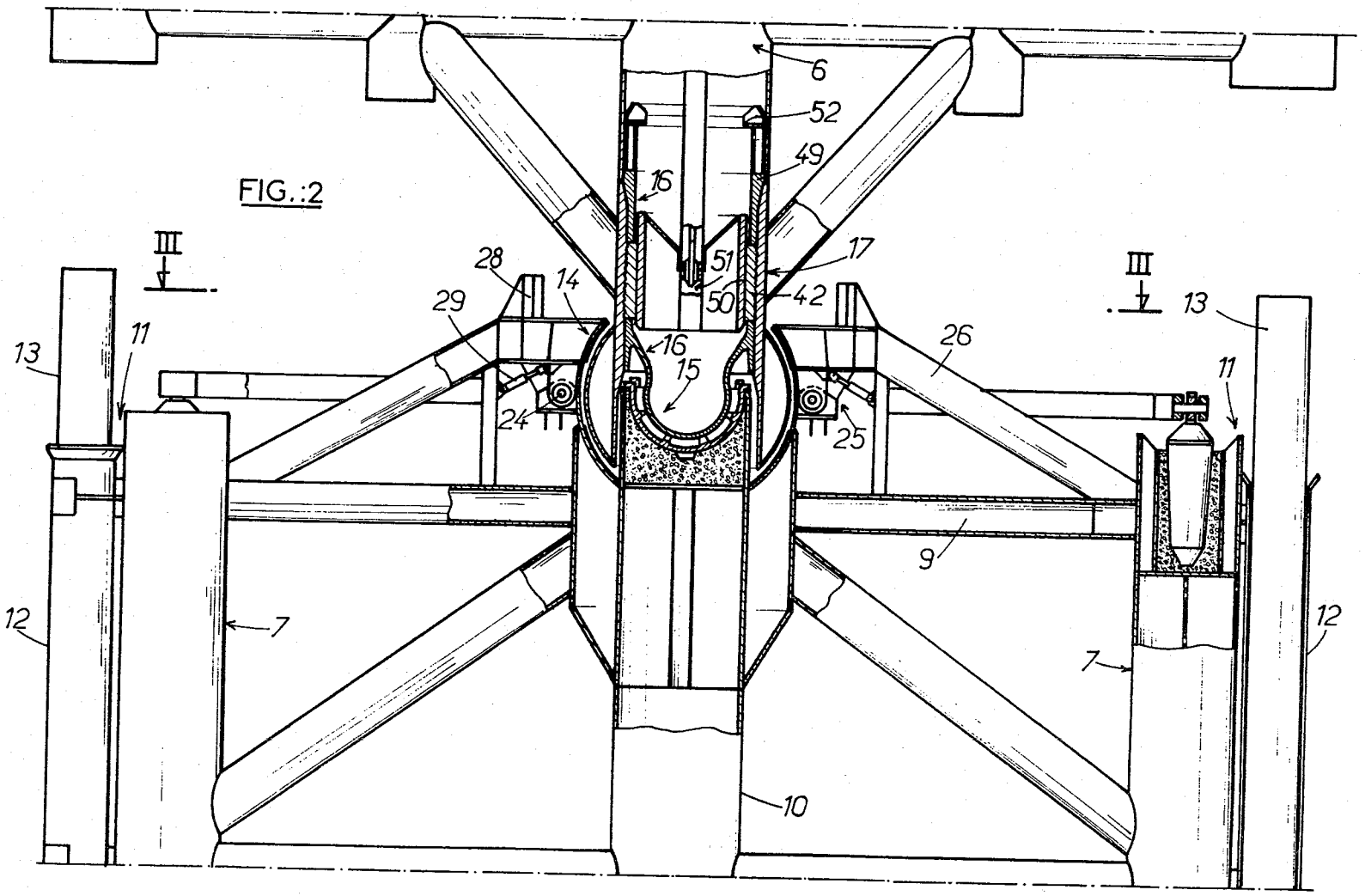
FIG. 2 is a view of the device 5 in FIG. 1 shown on a larger scale.

FIG. 1 shows an example of an oscillating marine platform comprising a device according to the invention. The platform is conventionally composed of a shaft 1 extended on its upper part by a structure of floats 2 which support the bridge and the drilling or working installations 3. The lower part of the shaft is connected to the base 4 fixed to the sea bed by means of the device 5 for connecting and disconnecting the swivel. A passage 6 is provided along the axis of the shaft, and this extends from the device 5 to the surface of the bridge. Its function is explained further on.

According to the embodiment shown (FIGS. 1, 2, 3), the shaft is a hexagonal latticed structure extended on its upper part by a concrete structure serving as floats 2. The passage in the steel lattice of the shaft is formed by a steel tube passing through a free area provided in the centre of the concrete structure.

The hexagonal base (FIG. 3) has at its apices tubular feet 7 which are held in position by lateral bracing and radial bracing 9. The radial bracing holds a central support 10 bearing the swivels. Each foot 7 is at least partly surrounded by a cylinder 11 made up of several sleeves 12 through which feet 13 pass, these feet being sunk into the sea bed in order to secure the base.

The device according to the invention is equally suitable for platforms made completely of concrete or of steel.

The device for connecting and disconnecting a swivel (FIG. 2) according to the invention comprises a first swivel 14 or mooring swivel arranged concentrically on the outside of a second swivel 15 or bearing swivel, which is fixed on the end of the shaft by means of a cartridge 16 placed in a tube 17 forming an extension of the passage 6. This passage enables the cartridge to be dismantled (see FIG. 7) and to be brought back to the surface on the bridge.

The first swivel 14 (FIG. 4) comprises:

an outer bush 18 formed in two parts: a lower hemispherical part 19 limited by the diametral horizontal plane, and passed through axially and perpendicularly to the horizontal plane by part of the central support 10, the upper edge of which lies in the diametral horizontal plane, and a discontinuous upper part 20 formed by spherical sectors 21;

a spherical interior ring 22 fixed to the end of the tube 17 forming an extension of the passage 6. The outer diameter of the ring is less than the inner diameter of the outer bush 18.

Figure 3:
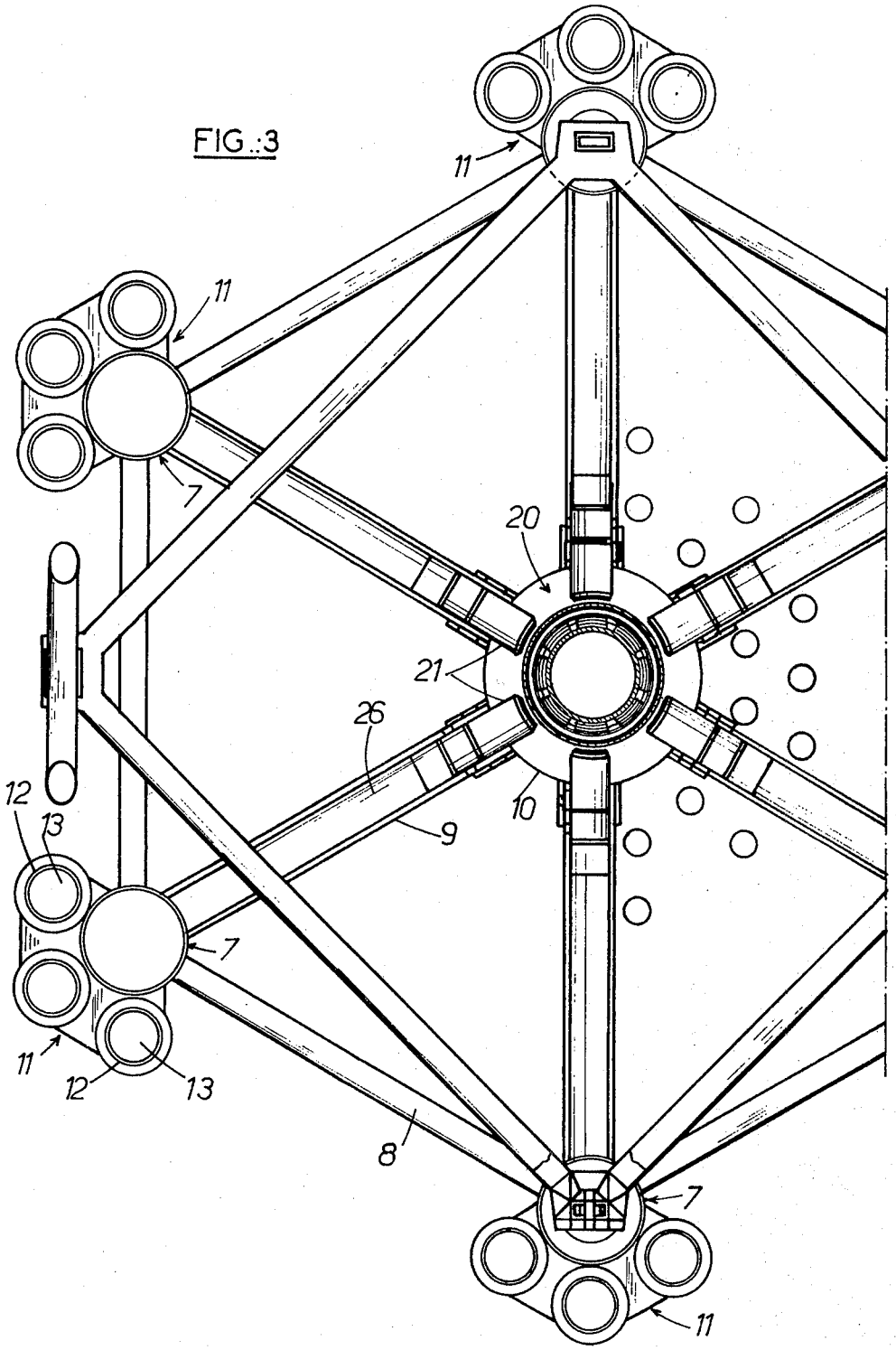
FIG. 3 is a partial view along the line III—III in FIG. 2.
Figure 4:
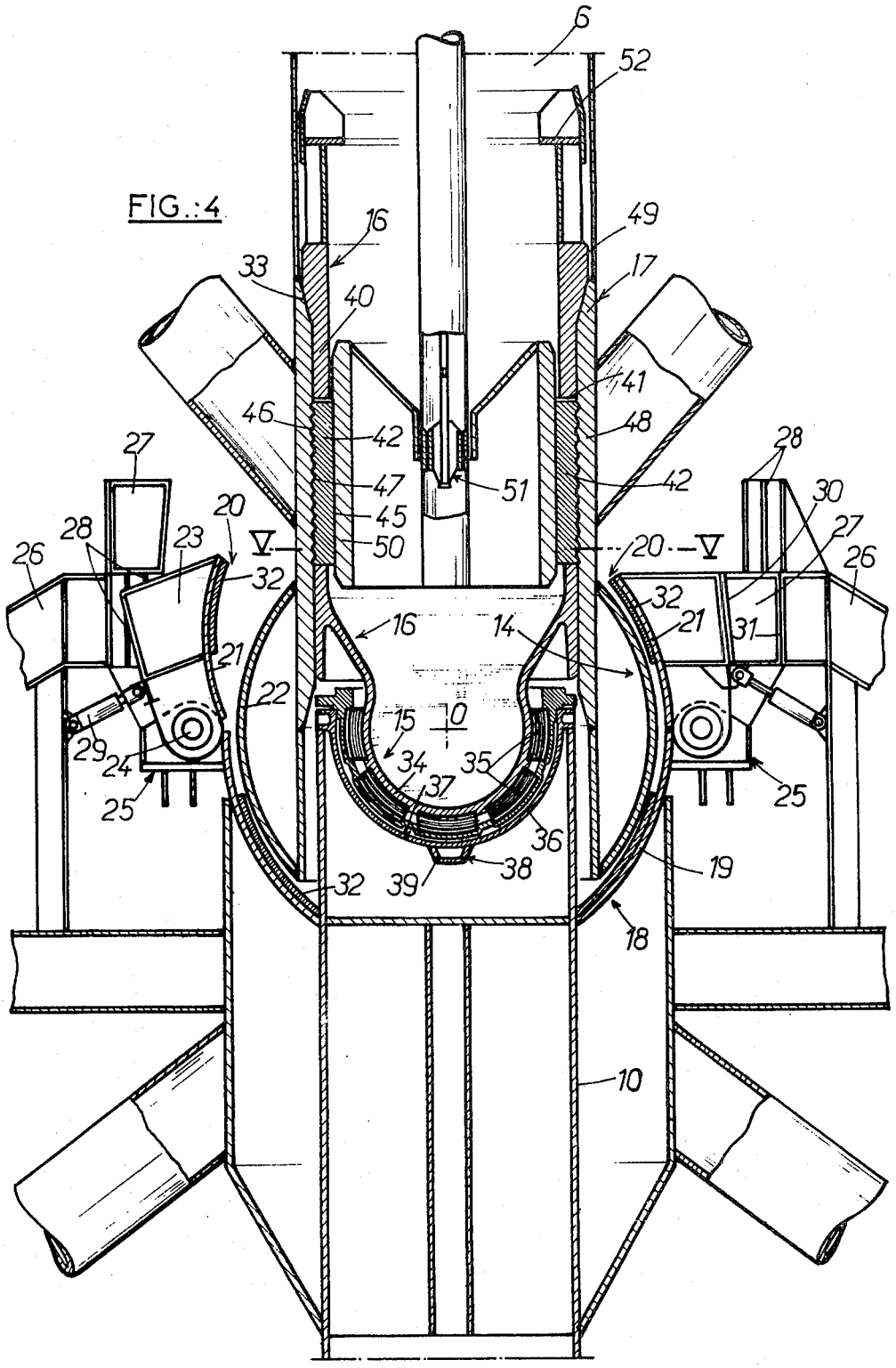
FIG. 4 is a sectional view of the device according to the invention.

The movable spherical sectors 21, forming the discontinuous upper part 20, can be moved aside so as totally to disengage the diametral opening of the lower part 19 so as to enable the spherical ring 22 to enter. In order to do this, the sectors 21 are fixed to the ends of shoes 23 movable round pivots 24, held in supports 25 fixed to the base by cross-braces 26 (FIGS. 2 and 3). These supports also carry clamping means comprising wedges 27 which slide under gravity on slideways 28. The left-hand part of FIG. 4 shows the relative positions of the different elements when the diametral opening of the bush is disengaged. The shoe 23 is held back by a jack 29, the wedge 27 being held in its uppermost position by the upper surface of the shoe. In order to bring down the sectors coaxially after entry of the part 22, the jack 29 is operated which turns the shoe, thus freeing the path for the wedge 27 (right-hand part of FIG. 4). This descends under its own weight and becomes locked between the back surface 30 of the shoe and the front surface of a stop 31 which is integral with the support 25. The lower part 19 of the bush and the sectors 21 have friction plates 32.

Figure 10:
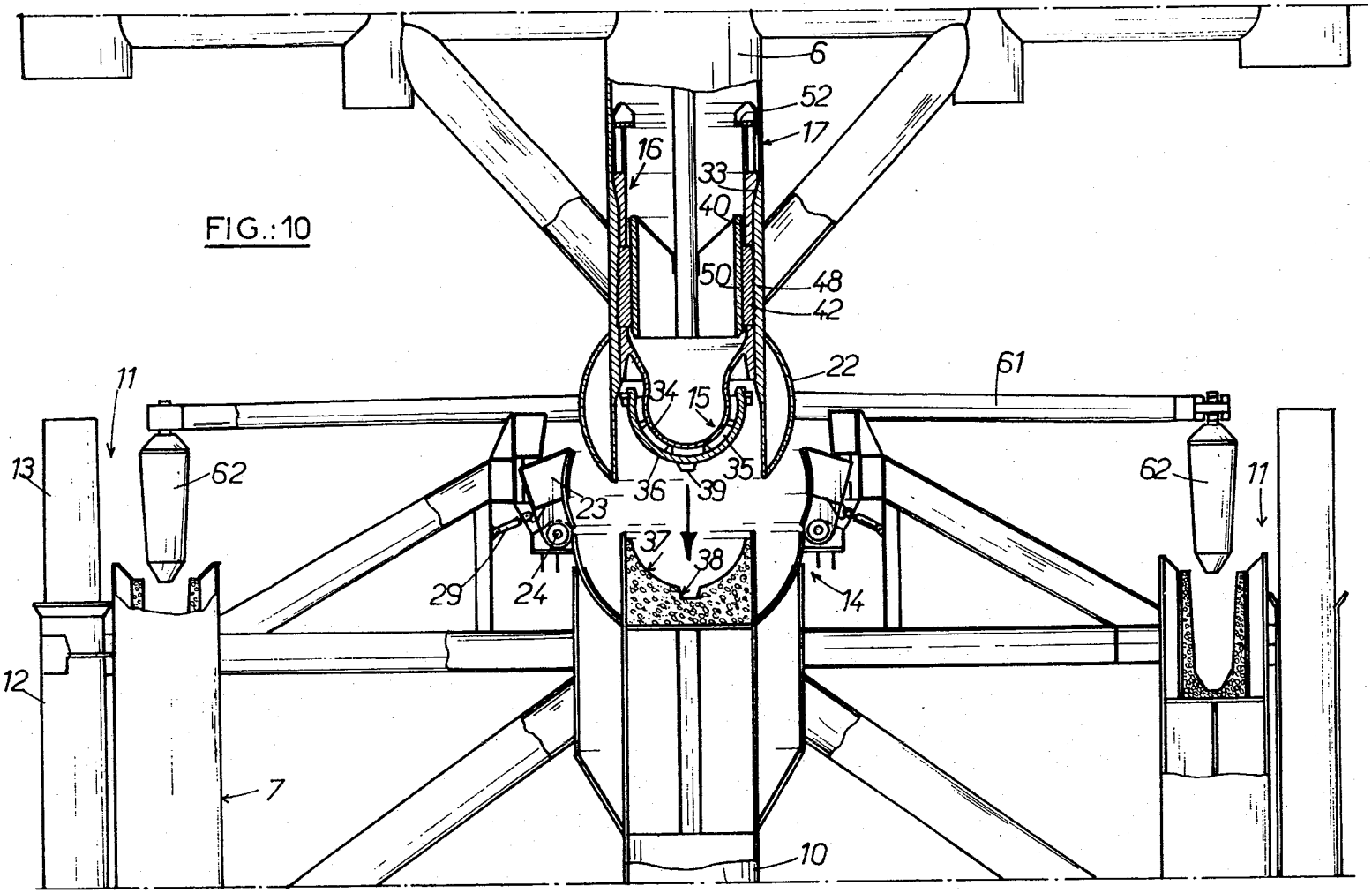
FIG. 10 shows the initial connection of the shaft to the base.

In FIG. 10, the tube 17 can be seen passing beyond the lower end of the shaft, the spherical ring 22 of the mooring swivel 14 being fixed to it, the said tube comprising means which permit the positioning of the cartridge 16 bearing at least part of the bearing swivel 15. At one end of the cartridge, which is generally cylindrical in shape, a convex spherical surface 34 is attached. Studs 35, formed, as is known, by alternate layers of elastomer and metal sheets in the form of spherical caps, vulcanised together, are fixed, on the one hand, by means of their concave supports to the convex spherical surface 34 and, on the other hand, by means of their convex supports to a hemi-spherical bush 36. This bush cooperates with a housing 37, which has a corresponding shape and diameter, provided in the upper part of the central support 10. According to the embodiment shown, this housing 37 comprises a concrete body, in the base of which there is provided a honeycomb-shaped recess 38 cooperating with a projection 39 fixed to the lower part of the bush 36. The projection 39 penetrates the honeycomb-shaped recess 38 without appreciable clearance and immobilises the bush in the housing. Thus, during oscillation of the shaft, the studs allow the movement due to their deformability.

In FIG. 4, details of construction of the cartridge 16 can be seen, this cartridge being composed of a cage 40, obtained by making openings 41 in a cylindrical tubular body, the purpose of these openings being to receive wedge-keys 42. In FIG. 5, it can be seen that the longitudinal side edges 43, 33 of the openings taper slightly, which permits a limited movement of the wedge-keys 42 towards the centre of the cage, whilst preventing them from passing through it. The internal surface 45 provided by the keys is conical and forms a projection in relation to the inner wall of the cage, the smallest diameter being near to the lower end. The external surface provided by the keys forms annular grooves 46. The grooves 46 can cooperate with grooves 47 which have similar characteristics and are machined on the internal surface of a thick tubular part 48 of the central tube 17. This thick tubular part 48 presents, at its upper connection with the smallest thickness of the tube, a conical projection 33 on which rests a conical flange 49 which is provided on the external surface of the upper part of the cage 40. The projection 33 and the flange 49 position the centre of the swivel 15 so that it is identical to the centre 0 of the swivel 14. A conical ring 50 is provided to come into contact with the internal conical projecting surface 45 provided by the keys 42 (see also FIG. 5) and to keep the grooves of the external surface provided by the keys engaged with the grooves of the thick tubular part 48. The ring 50 has at its centre connecting means 51, these being a set of rods. The upper part of the cage 40 is partly closed by a ring 52, the inner diameter of which is less than the diameter of the ring 50 which is thus enclosed in the cartridge 16. The distance separating the ring 52 from the upper edges of the openings of the cage is greater than the height of the ring 50.

The method for connecting and disconnecting the swivel of an oscillating platform making use of a device according to the invention is described below.

FIGS. 6, 7, 8 and 9 show the initial assembly of the bearing swivel 15, which is carried out in the workshop. The cage 40, at the end of which is mounted the swivel 15 made up of the hemispherical convex surface 34, the flexible studs 35 and the concave bush 36, is placed in a cradle 53. Scaffolding 54 surrounds the cage, and a floor 55 is fitted at the level of the lower edges of the openings 41. The keys 42, shown by a dotted line, are arranged opposite each opening 41 (six openings according to the embodiment). The keys are fed into the corresponding openings by means of moving devices 56. The keys are kept towards the interior of the cage by thrust against the longitudinal edges of the openings. When all the keys have been placed in their openings, they are encircled from the outside by means of cables 57, for example, (FIG. 7), to prevent them from moving. The scaffolding is dismantled (FIG. 7), and the conical ring 50 is conveyed by means of a crane and is held in the cage above the keys by pins 58. The upper end of the cartridge is closed by welding the ring 52 onto the cylindrical ferrule 59 which forms an extension of the cage 40. The ring has on its outer edge a cylindro-conical crown 60 which ensures its rigidity. After removing the pins 58, the cartridge 16, which is suspended on the ring 50 which is supported on the ring 52, is transported to the site for assembling the shaft. After removing the hooping from the keys, the cartridge is lowered into the tube 17 (FIG. 8) so as to allow the flange 49 of the cage to make contact with the projection 33. In this position, the grooves provided on the internal surface of the tubular part 48, complementary to those on the external surfaces of the keys, are approximately opposite to each other. The ring 50 is lowered between the keys (FIG. 9) and is locked there by the action of its own weight.

The construction of the structure is then completed in the normal way, and the platform is towed to the site where the base bearing part of the swivels is already installed. FIG. 10 shows the phase of connecting the swivels. The shoes 23 held by the exterior bush of the mooring swivel 14 are moved aside, and the spherical ring 22 enters between the shoes. The bearing swivel 15 is brought to rest by engagement of its bush 36 in a concrete housing 37 provided in the base. The shoes 23 are then re-locked on the spherical ring 22 and partly reconstitute the upper concave spherical surface of the swivel 14. A torsion frame 61, the purpose of which is to prevent the rotation of the shaft around its longitudinal axis, is fixed by plugs 62 in the usual manner in housings provided in the base.

The tower is then ballasted so as to exert, according to the embodiment described here, a downward vertical force of the order of 15,000 T; this force, being greater than and in the opposite direction to the Archimedes thrust and to the upthrust due to the action of the elements, permanently compresses the bearing swivel 15. The mooring swivel 14 thus presents between its convex and concave surfaces a concentric clearance which, in the embodiment described, is of the order of 1.50 meters for a diameter of the inner swivel of around 8 meters.

To disconnect the bearing swivel (FIG. 11), the procedure is as follows:

A set of rods 63, the end of which is fixed in the connecting means 51 of the ring 50, is lowered through the axial passage 6. The set of rods is submitted to a tension of around 1.5 times the weight of the ring. The ballast is progressively removed from the structure so as to give it a slightly positive buoyancy. The bush 36 of the bearing swivel 15 is withdrawn from the housing 37 and is thus freed from the central support 10 on the base 4. The rising of the structure is limited by the mooring swivel 14 and more especially by the upper part of the bush 20 formed by the sectors 21 (see also FIG. 4). The upper part of the sperical ring 22 comes into contact with the friction plates 32 provided on the sectors 21 and allows the shaft to oscillate freely during the operation of lifting the cartridge. The set of rods 63 is raised so as to raise with it the ring 50, in abutment with the circular ring 52. The keys 42 are thus freed, and continued lifting causes the ridges in the tube 48 to push the keys 42, which causes them to be moved towards the centre of the cartridge. The unit comprising the cartridge with its bearing swivel is raised through the passage 6 onto the bridge of the platform, where the changing or repair of the defective parts can be proceeded with.

Figure 12:
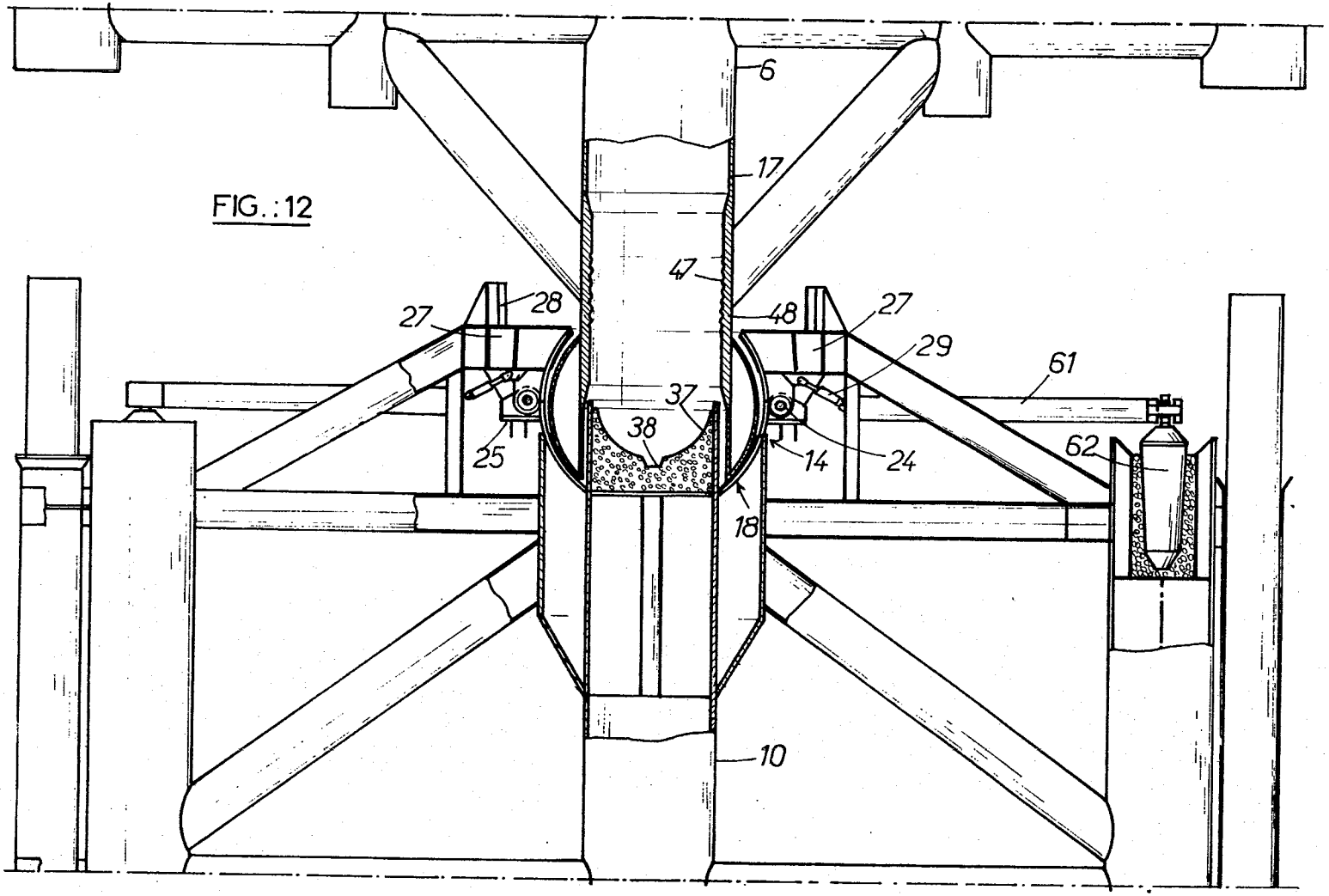
FIG. 12 shows the waiting phase, the mooring swivel acting as the bearing swivel.

As soon as the bearing swivel is disconnected, the structure is temporarily made heavier by ballasting, so as to make it rest on the lower part 18 of the mooring swivel 14 (FIG. 12). This lower part of the swivel is provided to bear the forces thus generated.

After the bearing swivel 15 has been separated, it is put in place again by reversing the method used for dismantling.

Figure 11:
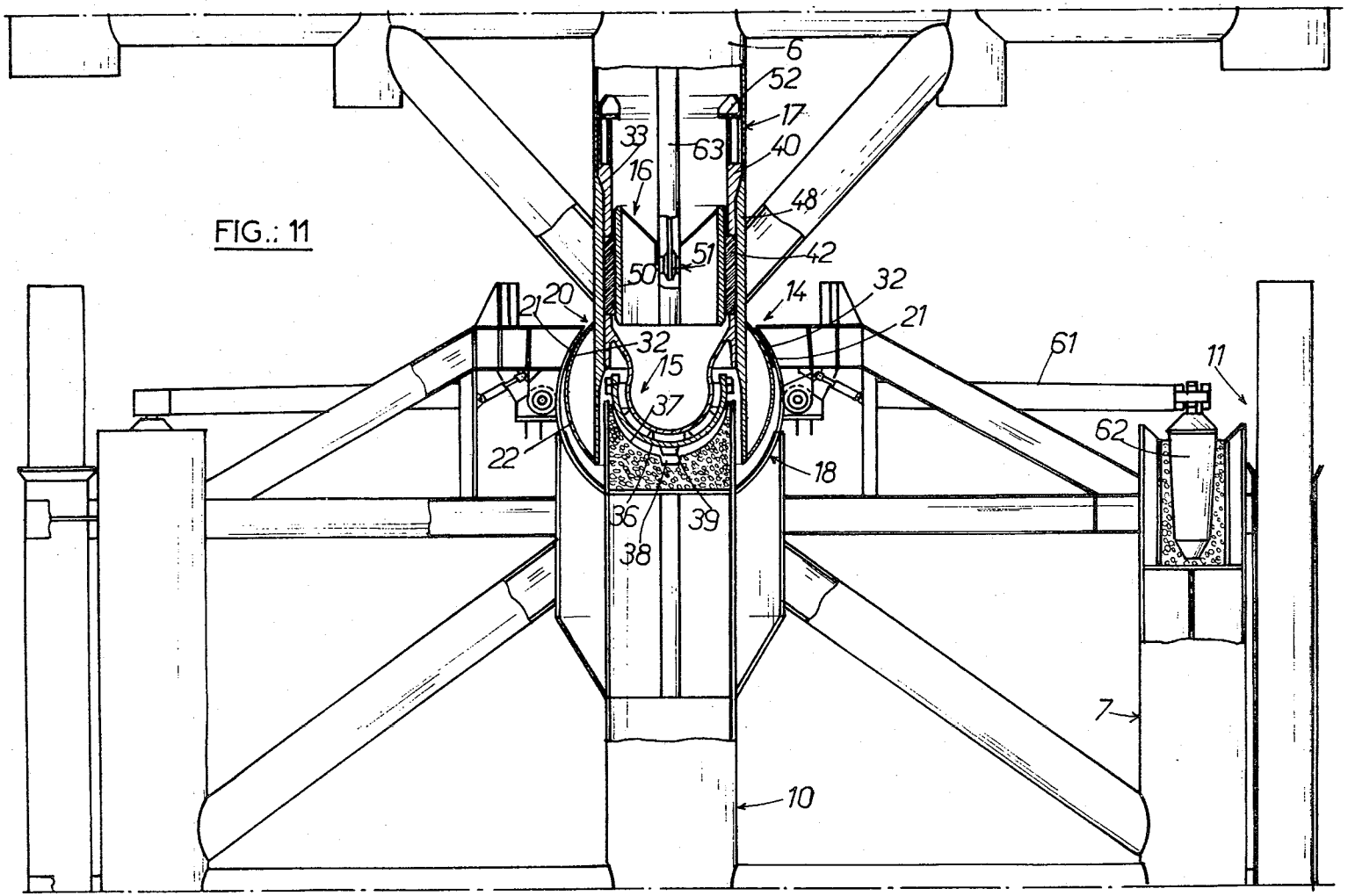
FIG. 11 shows a phase of the disconnecting of the bearing swivel.

The ballast is removed from the structure so as to give it slightly positive buoyancy, and the spherical ring 22 is in abutment with the shoes 23. The bearing swivel 15 is lowered by means of the set of rods until the conical flange 49 is supported on the projection 33. The ring 50 then continues to descend by its own weight and pushes back the keys 42 until their grooves are engaging with the grooves of the thick tubular part 48. A clearance continues to exist between the hemispherical bush 36 and the housing 37 (FIG. 11).

The normal operating position is then regained. To do this, the structure is progressively ballasted, which brings the bush 36 into contact with the housing 37 provided in the central support of the base. The set of rods is freed from the ring then raised.

The bearing swivel has thus been changed without the shaft being separated from the base and without requiring the intervention of divers or underwater appliances.

We claim:

1. A marine platform structure, comprising:

an oscillating marine platform, said platform including a shaft having a tube projecting from the lower end thereof;

a base fixed on the sea bed;

a swivel means for connecting the lower end of the shaft to said base, said swivel means comprising:

a first spherical swivel member arranged at the lower end of the shaft and adapted to engage a first swivel receiving means arranged in the base;

a cartridge removably secured within the tube adjacent the lower end thereof; and a second spherical swivel member fixed to the end of said cartridge and adapted to engage a second swivel receiving means arranged in the base;

whereby said second swivel member together with said cartridge is adapted to be disengaged and removed from the second swivel receiving means while said first swivel member remains engaged with the first swivel receiving means.

2. A device according to claim 1, wherein the first swivel member comprises an outer spherical bush, partly passed through along a vertical diameter by part of a central support fixed to the base, the end of the said part of the support bearing the second swivel member, and an inner spherical ring fixed to the outer end of the tube which forms an extension of the axial passage of the shaft, this inner spherical ring being capable of cooperating with the outer bush.

3. A device according to claim 1, wherein the second swivel member comprises a convex spherical surface fixed to the end of the cartridge, a flexible fitting and a hemispherical bush, the fitting being fixed between the convex spherical surface and the hemispherical bush, the said bush being held in a movable manner in the part of a central support which passes through the outer bush of the first swivel member.

4. A device according to claim 3, wherein the cartridge comprises: a cage formed by a cylindrical tubular body comprising openings, wedge-keys, the shape and dimensions of which are adapted to penetrate at least partly the openings, the internal surface of the keys being conical and projecting in relation to the inner wall of the cage, and the external surface having annular grooves, a conical ring which can be placed inside the cage and between the keys, the shape and dimensions of the ring being adapted to fit against the internal conical surfaces of the keys, connecting means in the form of a set of rods being provided on the axis of the ring, a ring fixed on the upper part of the cage, having an inner diameter less than that of the ring and partly closing the cage, the distance of the ring from the upper edges of the openings of the cage being at least equal to the height of the ring, and an annular conical flange provided on the outer wall of the cage, capable of cooperating with a corresponding projection provided on the internal surface of the tube in which the cartridge is placed.

5. A device according to claim 4, wherein the part of the tube in which the cartridge is held has part of its diameter less than that of the part which forms an extension of the passage, the upper edge of the said part forming a conical projection which is capable of cooperating with the conical flange of the cartridge.

6. A device according to claim 4 wherein the inner surface of the tubular part has annular grooves which can cooperate with the annular grooves provided in the external surfaces of the keys.

7. A device according to claim 3, wherein the part of the central support which passes through the outer bush of the first swivel member has a housing for the hemispherical bush of the second swivel member, the said housing being composed of a molded body, said body being molded on the hemispherical bush.

8. A device according to claim 7, wherein the hemispherical bush of the second swivel member has on its lower part a projection which is capable of cooperating with a corresponding honeycomb-shaped recess provided on the lower part of the housing.

9. A device according to claim 1, wherein the outer bush of the first swivel member is formed in two parts: a lower hemispherical part limited by a diametral horizontal plane, and passed through along a vertical diameter and perpendicularly to the said horizontal plane by a part of the central support, the upper edge of which is in the horizontal plane, and a discontinuous upper part in the form of mobile spherical sectors.

10. A device according to claim 9, wherein the spherical sectors are fixed on the end of shoes movable around the axes, held in the supports fixed to the base, the said supports having clamping means comprising wedges which slide by gravity on slideways and which come between the back surface of the shoes and the front surface of a stop which is integral with the support.

11. A method for connecting and disconnecting the swivel of an oscillating marine platform, said swivel being arranged between the lower end of a shaft and a base fixed on the sea bed, said swivel comprising:

a first spherical swivel member arranged on the outside of a tube which projects from the lower end of the shaft and forms an extension of an axial passage in the shaft, and a second spherical swivel member fixed to the end of a cartridge held in a removable manner in the tube by means of keys cooperating within the tube, wherein the second swivel member comprises a convex spherical surface fixed to the end of the cartridge, a flexible fitting and a hemispherical bush, the fitting being fixed between the convex spherical surface and the hemispherical bush, the said bush being held in a movable manner in the part of a central support which passes through the outer bush of the first swivel member, said cartridge comprising a cage formed by a cylindrical tubular body comprising openings, wedge-keys, the shape and dimensions of which are adapted to penetrate at least partly the openings, the internal surface of the keys being conical and projecting in relation to the inner wall of the cage, and the external surface having annular grooves, a conical ring which can be placed inside the cage and between the keys, the shape and dimensions of the ring being adapted to fit against the internal conical surfaces of the keys, connecting means in the form of a set of rods being provided on the axis of the ring, a ring fixed on the upper part of the cage, having an inner diameter less than that of the ring and partly closing the cage, the distance of the ring from the upper edges of the openings of the cage being at least equal to the height of the ring, and an annular conical flange provided on the outer wall of the cage, capable of cooperating with a corresponding projection provided on the internal surface of the tube in which the cartridge is placed, the shaft being connected to the base by means of the said device and exerting on the second swivel member a pressure which is greater than and in the opposite direction to the Archimedes pressure and to the upthrust due to the action of the elements, wherein a set of rods is lowered through the axial passage in the shaft to hook on to the ring, the set of rods is submitted to a pressure of around 1.5 times the weight of the ring, the ballast is progressively removed from the structure so as to give it a slightly positive buoyancy, the bush of the second swivel member is withdrawn from its housing in the base, the rising of the structure is limited by the upper parts of the spherical ring of the first swivel member coming into contact with the bush formed by the mobile sectors which are integral with the base, the set of rods is raised so that the ring is in abutment with the circular ring of the cartridge and the keys are freed, and the cartridge, on which the second swivel member is fixed, is brought to the bridge.

12. A method according to claim 11 enabling the safety of the tower to be ensured whilst the second swivel member is disconnected, wherein the shaft is ballasted in such a way that the lower part of the spherical ring rests on the internal surface of the outer bush of the first swivel member.

13. A method according to claim 11 enabling the connection of a second swivel member to be ensured, wherein the ring on which the cartridge is suspended is fixed to the end of a set of rods, the cartridge is lowered through the axial passage of the shaft until the conical flange of the cartridge rests on the conical projection of the tube, the ring is lowered under the action of its own weight between the keys which it pushes aside and presses against the wall of the tube, the set of rods is disengaged, the shaft is progressively ballasted so that the bush of the second swivel member moves into the housing of the central support of the base, and ballasting is carried out to the desired degree in order to keep the second swivel member under permanent compression.

14. A method for connecting and disconnecting the swivel of an oscillating marine platform, said swivel being arranged between the lower end of a shaft and a base fixed on the sea bed, said swivel comprising:

a first spherical swivel member arranged on the outside of a tube which projects from the lower end of the shaft and forms an extension of an axial passage in the shaft, and a second spherical swivel member fixed to the end of a cartridge held in a removable manner in the tube by means of keys cooperating within the tube, wherein the outer bush of the first swivel member is formed in two parts: a lower hemispherical part limited by a diametral horizontal plane, and passed through along a vertical diameter and perpendicularly to the said horizontal plane by a part of the central support, the upper edge of which is in the horizontal plane, and a discontinuous upper part in the form of mobile spherical sectors, to connect the shaft to the base while the platform is being put in position, the lower end of the shaft being fitted with a cartridge carrying the second swivel member, wherein the base is fixed to the sea bed, the mobile sectors are pushed aside so as to free the entrance of the lower part of the bush of the first swivel member, the shaft fitted with the second swivel member is brought above the opening of the bush of the first swivel member, the shaft is ballasted so that the bush of the second swivel member penetrates the housing of the central support, the mobile sectors of the upper part of the first swivel member are closed around the upper part of the spherical ring, the said sectors are locked in the closed position, and the shaft is ballasted to the desired weight so that the second bearing swivel member is kept under permanent compression.

* * * * *